US005554815A

United States Patent [19]

Authie et al.

[11] Patent Number: 5,554,815

[45] Date of Patent: Sep. 10, 1996

[54] MUNITION CONSTITUTING A CARTRIDGE-LAUNCHER LOADER, IN PARTICULAR FOR COUNTERMEASURE CARTRIDGE-LAUNCHER ON AIRCRAFT

[75] Inventors: Christian Authie, Muret; Philippe Cassagne, Fonsorbes, both of France

[73] Assignee: Etienne Lacroix Toux Artifices S.A., Muret, France

[21] Appl. No.: 301,276

[22] Filed: Sep. 6, 1994

[30] Foreign Application Priority Data

Sep. 6, 1993 [FR] France ..... 93 10555

[51] Int. Cl.[6] ..... F41F 3/00

[52] U.S. Cl. ..... 89/1.59; 89/1.51; 89/1.816

[58] Field of Search ..... 89/1.59, 1.51, 89/1.11, 1.816; 102/505; 342/12

[56] References Cited

U.S. PATENT DOCUMENTS

| | | | |
|---|---|---|---|
| 3,708,563 | 1/1973 | Sells | 264/45 |
| 3,808,940 | 5/1974 | Schillreff et al. | 89/1.51 |
| 4,063,485 | 12/1977 | Carter et al. | 89/1.816 |
| 4,309,705 | 1/1982 | Ulin | 102/505 |
| 5,206,453 | 4/1993 | Rieger | 89/1.51 |
| 5,359,918 | 11/1994 | Meili et al. | 89/1.816 |
| 5,411,225 | 5/1995 | Lannon et al. | 244/137.1 |
| 5,413,024 | 5/1995 | Plummer | 89/1.816 |

FOREIGN PATENT DOCUMENTS

| | | |
|---|---|---|
| 072261 | 2/1983 | European Pat. Off. . |
| 538105 | 4/1993 | European Pat. Off. . |

*Primary Examiner*—Michael J. Carone
*Assistant Examiner*—Christopher K. Montgomery
*Attorney, Agent, or Firm*—Pollock, Vande Sande & Priddy

[57] ABSTRACT

A munition constituting a cartridge-launcher loader comprises a plurality of consumable modules each in the form of a flat strip of juxtaposed cartridges each comprising a payload of chaff, an ejector pyrotechnic charge, an electrical initiator, and a reusable support receiving the strips. The support has a system for immobilizing the strips and a handle for transporting and installing it. The strips are juxtaposed at their flat surface to perform a homogeneous block essentially constituting the body of the munition or a part thereof. The support includes a fixed plate carrying the strips and receiving the latter, when they are inserted, by virtue of them sliding in a general direction parallel to the plane of the plate.

6 Claims, 4 Drawing Sheets

MUNITION CONSTITUTING A CARTRIDGE-LAUNCHER LOADER, IN PARTICULAR FOR COUNTERMEASURE CARTRIDGE-LAUNCHER ON AIRCRAFT

BACKGROUND OF THE INVENTION

1. Field of the invention

The present invention concerns onboard pyrotechnic devices, for aircraft in particular, and, to be more precise, systems combining in a single device or "cartridge-launcher" a plurality of pyrotechnic charges which can be fired in succession, for example to launch chaff such as infra-red or electromagnetic chaff.

2. Description of the Prior Art

EP-A-0 538 105 describes a munition of this type which has a rack with individual cells extending through the rack. The munition is loaded by inserting cartridges or blocks of three cartridges into the cells. The cartridges are inserted from one end of the cells, sliding axially along the entire length of the latter until they emerge from the other side of the rack.

This prior art munition has two drawbacks which limit its utility.

Firstly, the method of loading it requires the rack to be tilted to insert the various cartridges, after which a closing plate is fixed on to retain the cartridges and to close the bottom of the cells to prevent the cartridges from falling out after the rack is straightened to transport it and install it on the aircraft. All this implies a specific mechanical structure, polarizing systems, etc. and makes loading and reloading the munition time-consuming and difficult.

Secondly, and more importantly, the cellular rack system has mediocre characteristics in terms of usable payload as a proportion of the overall volume of the munition, which is particularly disadvantageous in the case of an aircraft where the space available is always very limited and where it is necessary to provide the greatest possible payload for a given volume.

SUMMARY OF THE INVENTION

The present invention proposes a munition which remedies these drawbacks by means enabling conveyance of a very much greater payload for a munition with the same outside dimensions and loading or reloading of the munition securely, quickly and simply; these advantages are achieved essentially by a design based on modules which can be nested and substitution of a support plate for the cellular rack.

The munition of the invention is of the general type described in the previously mentioned EP-A-0 538 105, i.e., it comprises a plurality of consumable modules each in the form of a flat strip of juxtaposed cartridges each comprising a payload of chaff, an ejector pyrotechnic charge, electrical initiator means, and a reusable support receiving the strips having means for immobilizing the strips and a handle for transporting and installing it. The strips are juxtaposed at their flat surface to form a homogeneous block essentially constituting the body of the munition or a part thereof, and the support includes a fixed plate carrying the strips and receiving the latter, when they are inserted, by sliding in a general direction parallel to the plane of the plate.

The plate and the strips advantageously comprise cooperating means, for example of the dovetail slot type, for simultaneously guiding sliding of the strips as they are inserted and mechanically coupling the strips to the plate.

In a preferred embodiment of the invention, the support further includes a wall perpendicular to the plane of the plate against which the strips abut at the end of insertion. In particular, this wall can be substantially centrally located relative to the surface of the plate, the plate carrying two groups of strips symmetrically disposed on respective sides of the wall and the strips of each group abutting against a respective one of the two opposite sides of the wall.

The strips can each include on their flat side a locking through-hole, the respective holes of the block of strips all being aligned, the munition then further comprising a locking pin inserted into the series of aligned holes of the block to fasten the strips together. In the aforementioned embodiment with a central wall, the pin can advantageously be a double pin with two branches straddling the wall and each inserted into the respective series of aligned holes in two groups of strips symmetrically disposed on opposite sides of the wall.

The side of the strip abutted against the wall advantageously carries a centering and locking pin which is inserted at the end of insertion into a cooperating hole in the wall. Alternatively, a hole is provided in the side of the strip abutting against the wall, into which hole a centering and locking pin carried by the wall is inserted at the end of insertion.

In accordance with another aspect of the invention the transport and installation handle can be a retractable handle carried by the wall and provided with lateral projections which, after insertion of the munition into the cartridge-launcher and retraction of the handle, locates in the gap between the munition and the cartridge-launcher, thereby eliminating any clearance between these two members, and holds the munition in place in the cartridge-launcher after folding down a locking stirrup of the cartridge-launcher, these projections further preventing folding down of the stirrup when the handle is deployed.

The means for guiding the strips and mechanically coupling the strips to the plate can preferably comprise a printed circuit fastened to the plate and carrying electrical tracks cooperating elastically with a homologous contact connected to the electrical initiator means of each cartridge in the strip.

The cartridges in each strip and their payload of chaff are preferably essentially square or rectangular in transverse cross-section with the width equal to the transverse dimension of the strip, less the wall thickness.

An embodiment of the invention will now be described with reference to the appended drawings.

DETAILED DESCRIPTION OF THE PREFERRED EMBODIMENT

Figure 1:
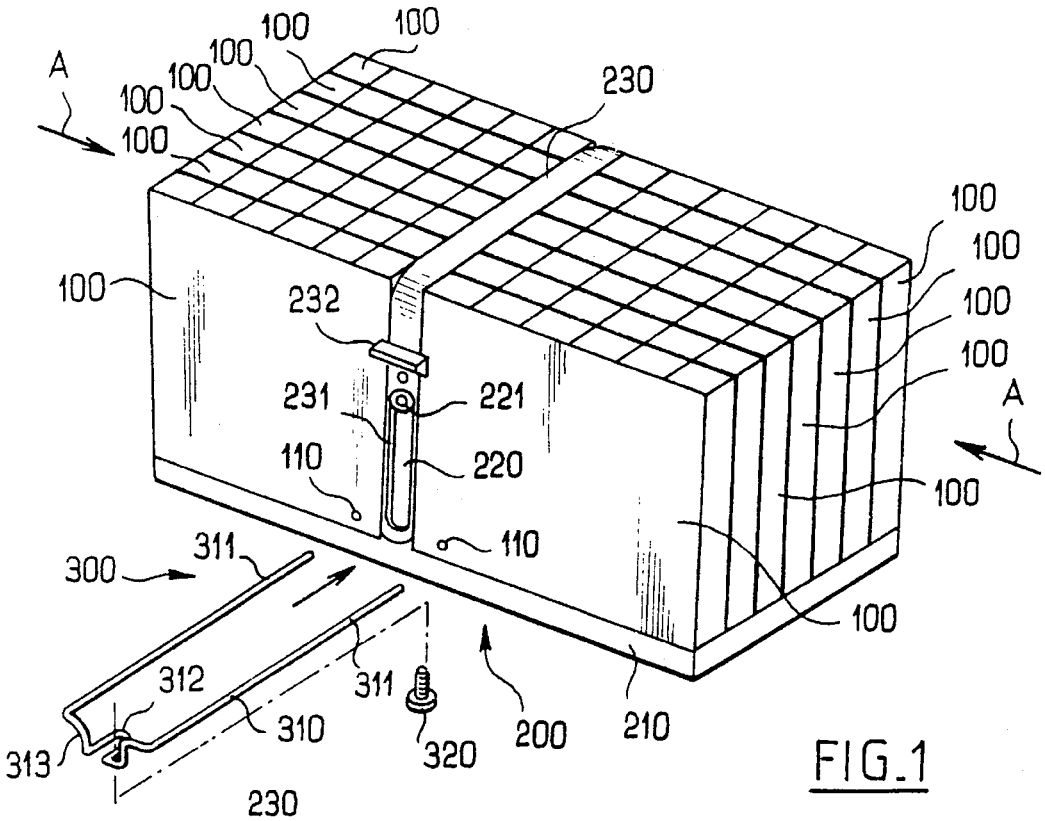
FIG. 1 is a general perspective view of the munition of the invention showing its various component parts.

FIG. 1 is a general view of the munition of the invention which essentially comprises a plurality of flat parallelpipedal shape modules or "strips" in contact with each other at their largest side to form a homogeneous block constituting a subassembly of the munition. In the purely illustrative example shown each module is represented as a strip of six juxtaposed cartridges, each of rectangular cross-section. These strips are grouped into two symmetrical groups each of seven strips, representing a total of 84 cartridges (loaded with infra-red or electromagnetic chaff, for example) divided into 14 strips each of six independently firable cartridges.

These strips constitute the consumable parts of the munition and they are mounted on a reusable support 200 comprising a horizontal (as shown) plate 210 and a vertical wall 220. The two subassemblies of seven contiguous strips are placed symmetrically on opposite sides of the wall 220, which carries a retractable handle 230 which is a permanent part of the munition, enabling it to be picked up and manipulated without difficulty.

Although this configuration with two blocks symmetrically disposed on opposite sides of a central wall is advantageous (particularly from the point of view of balancing the munition when it is carried by the handle), this is not indispensable to implementation of the invention, which could use a support plate with no central wall carrying a single block of strips in contact, or a plurality of juxtaposed blocks, or with a wall having some other configuration, etc.

Figure 4:
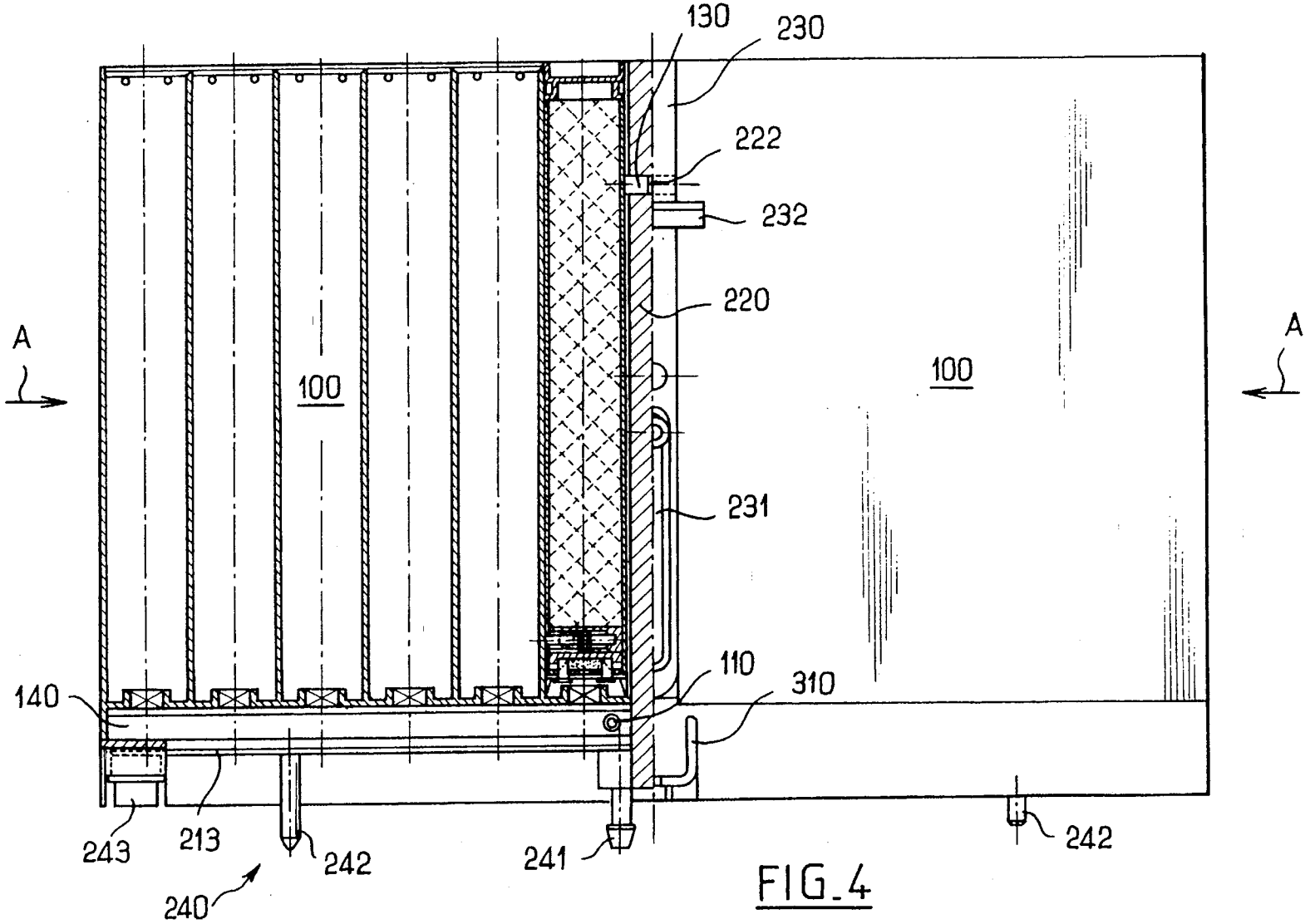
FIG. 4 is a side view perpendicular to the central wall of the munition of the invention, shown in cross-section in the lefthand part of the figure.

In a manner that characterizes the invention, the strips, when mounted on the plate, are slid in a general direction parallel to the plane of the plate, i.e., in the direction of the arrows A in FIGS. 1 and 4; specific means for holding and guiding the strips during this insertion are described below.

At the end of their travel, the various strips abut against the wall 220, and when all the strips have been installed they are fastened in place by means of a locking system 300 including a generally U-shaped metal pin 310 whose two parallel branches 311 are inserted into locking holes 110 through each strip and each block of strips so that, with one movement, fitting the pin immobilizes all of the strips on the support plate 210. The pin 310 is itself locked in place by means of a screw 320 (also seen in FIG. 7) which screws into the bottom wall of the plate 210 and is inserted into a homologous loop 312 in the central part 313 of the pin 310.

Figure 2:
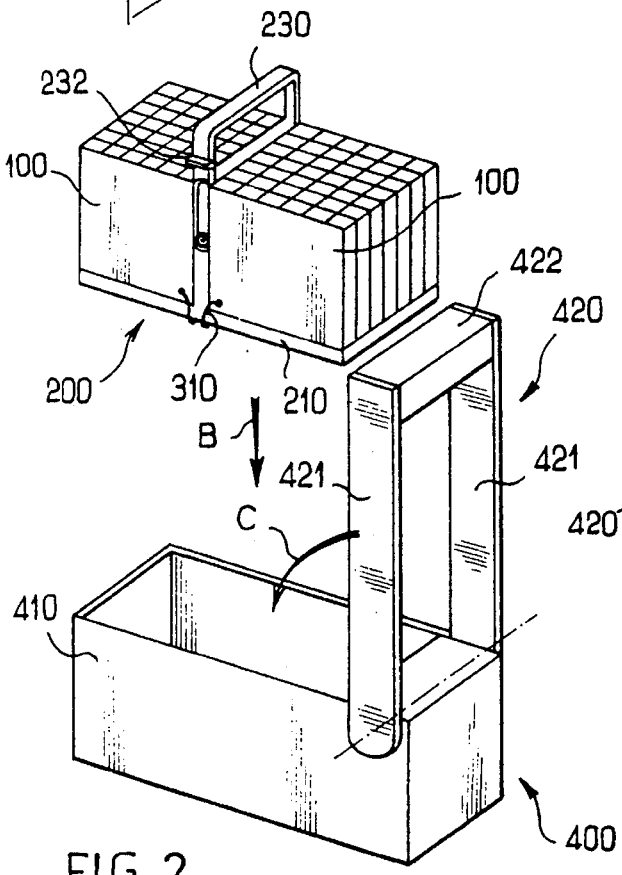
FIG. 2 shows how the FIG. 1 munition is installed in a cartridge-launcher, for which it constitutes a removable and reloadable loader.
Figure 3:
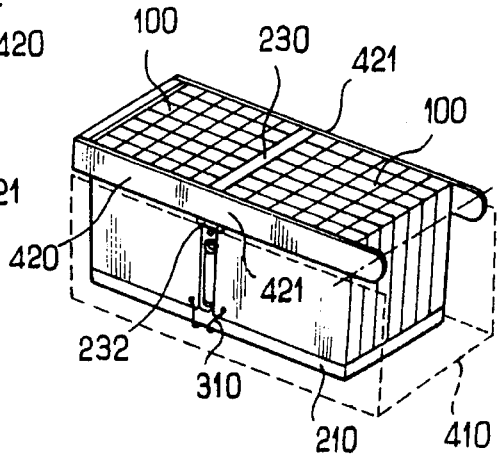
FIG. 3 is similar to FIG. 2, but shows the munition inserted and installed in the cartridge-launcher, the casing of which is shown in dashed outline.
Figure 7:
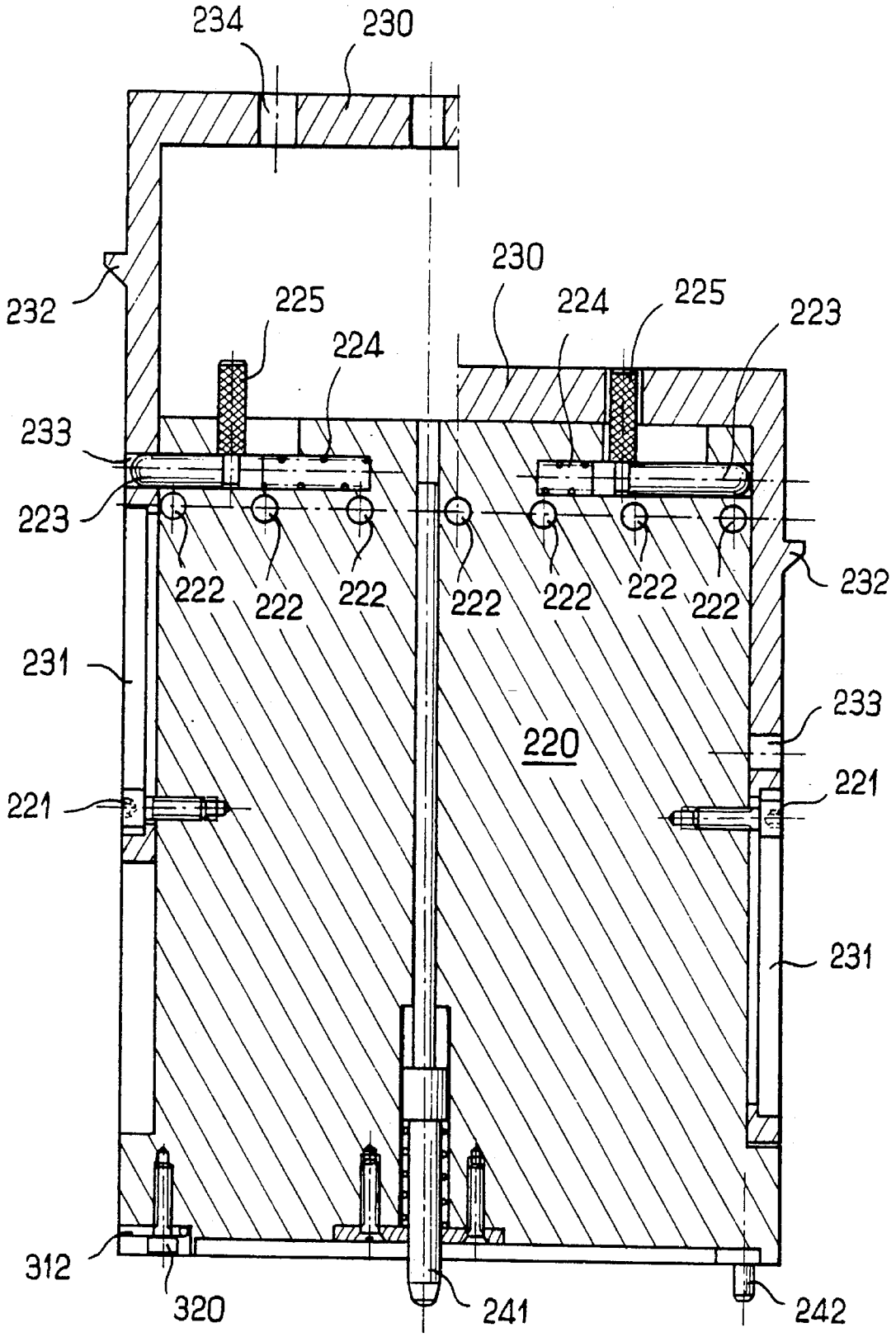
FIG. 7 is a view of the munition in transverse cross-section in the plane of the central wall, showing in particular the mechanical structure of the handle and its respective "transport" position on the left and its "flight" position on the right.

As can be seen in more detail in FIG. 7, the handle 230 used to transport and install the munition includes an oblong slot 231 cooperating with a fixed journal 221 fastened to the wall and defining the retracted position (as shown in FIGS. 1 and 3 and in the righthand half of FIG. 7) and the transport and installation position (as shown in FIG. 2 and the lefthand part of FIG. 7). The handle has a lateral projection 232 whose function is described below, and locking hole 233 cooperating with a retractable bolt 223 spring-loaded in the wall 220 by means of a spring 224 and a maneuvering finger 225. This bolt prevents the handle from dropping into the retracted position from the deployed position under its own weight; in the retracted position the maneuvering finger 225 is accommodated in an appropriate hole 234.

The function of the handle is to enable transportation of the munition after the plate has been equipped with its consumable strips and placed ("installed") in a cartridge-launcher 400 (see FIGS. 2 and 3) comprising a casing 410 receiving the munition after the strips of cartridges 100 have been installed and locked in place by means of the pin 310. The resulting assembly is then placed into the casing 410 (see arrow B in FIG. 2,) after which the handle is retracted. The assembly is then closed by folding down (see arrow C in FIG. 2) a locking stirrup 420 having two arms 421 linked by a lock unit 422. FIG. 3 shows the assembly in this final configuration (the "flight" position, which is the functional position in which the munition is ready to be fired), the casing 410 being shown in dashed outline.

The projections 232 lock the munition laterally after it has been inserted into the cartridge-launcher 410 by locating, when the handle 230 is retracted, in the gaps remaining between the outside wall of the munition and the inside wall of the casing 410 of the cartridge-launcher, to eliminate any clearance between these two members.

The projections 232 also constitute an additional safety feature at the time of installation, as their protruding position prevents complete folding down of the stirrup until the handle has been entirely retracted.

Finally, the projections 232 lock the munition into the cartridge-launcher simply by folding down locking stirrup, the arms 421 of which bear on the top surface of the projections, to prevent any movement or extraction of the munition.

Simply installing the munition of the invention into the cartridge-launcher makes the connection to the fire control systems of the aircraft through an interface 240 (FIG. 4) comprising a centering and mechanical locking pin 241 (seen also in FIG. 7), an electrical connection via a grounding pin 242 and a multipin connector 243 plugging into counterparts in the bottom of the casing 410 of the cartridge-launcher. The munition of the invention thus has a standardized mechanical and electrical interface and is a truly general purpose device.

Figure 6:
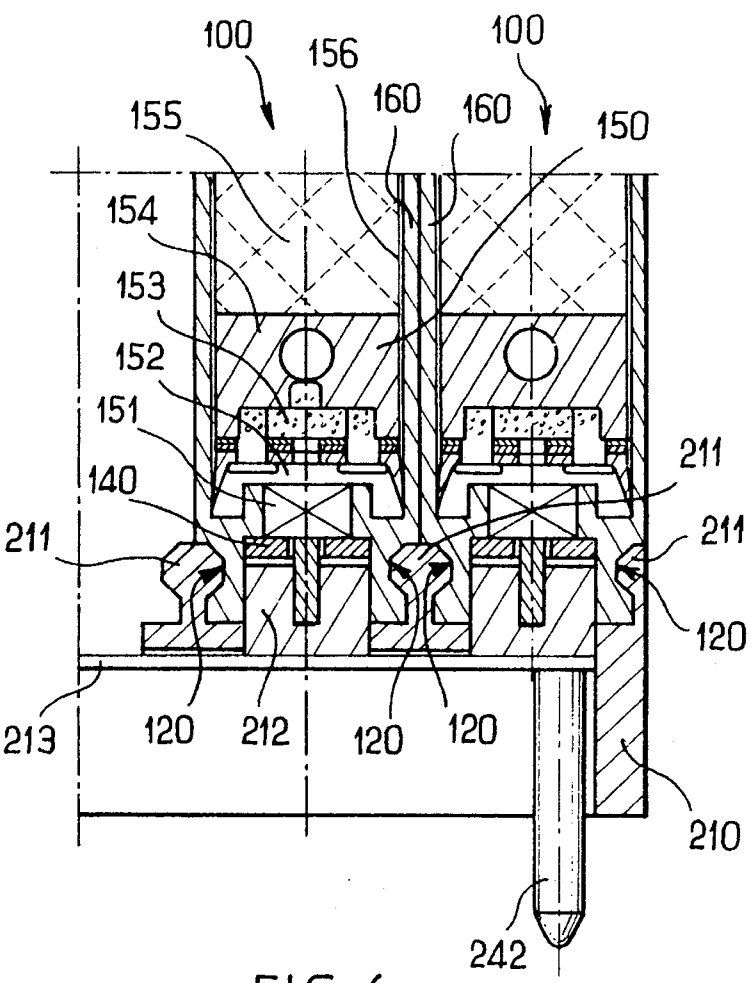
FIG. 6 shows the bottom righthand part of FIG. 5 on a larger scale and shows in cross-section how the strips cooperate mechanically and electrically with the plate supporting them.
Figure 5:
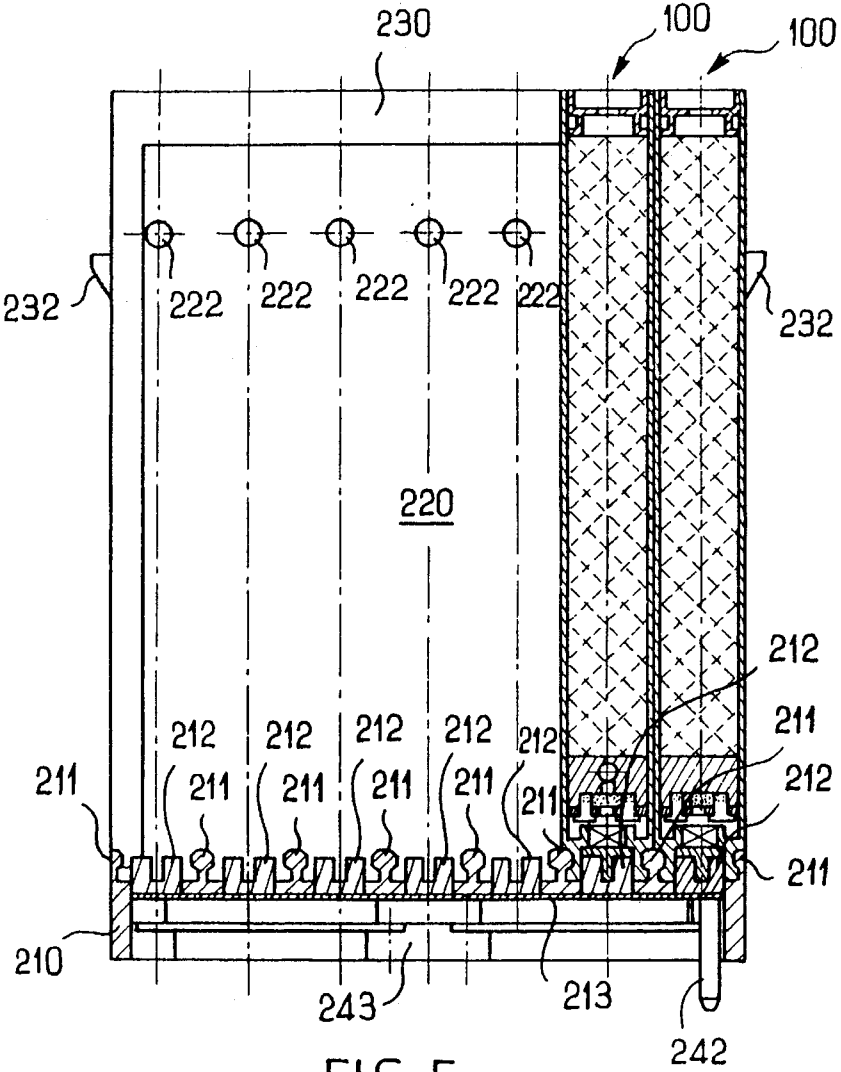
FIG. 5 is an end-on view of the munition with two strips inserted, the latter being shown in cross-section.

The manner in which the strips cooperate with the support to hold and retain them during insertion will now be described in more detail with reference to FIGS. 4 through 6.

The plate 210 advantageously includes (FIGS. 5 and 6) members 211 forming rails and defining a dovetail type profile cooperating with a homologous groove 120 formed along the flat sides of each of the strips 100. This rail assembly guides movement of the strips in translation as they are inserted.

The strips further include, on their front surface, a centering and locking pin 130 which is inserted into a homologous cooperating hole 222 in the wall 220 (this guiding and locking system is naturally not limiting on the invention). The holes 222 adapted to receive the pins 130 are advantageously located on the upper part of the wall, i.e., at a distance from the dovetail 120, 211, so as to provide maximum stiffness to counter vibration and other disturbing loads, the intensity of which will be maximal in the upper part of the wall and the strips.

The plate 210 also carries electrical contacts 212 of the "lyre" connector type mounted on a printed circuit 213 also carrying the control and command electronics (not shown) used to verify the integrity of the cartridges and to fire them in a coordinated fashion. The combination of the circuit and the lyre connectors is advantageously embedded in resin to provide mechanical strength and to seal it from polluting environments. This resin also provides a damper between the munition and the cartridge-launcher to withstand recoil forces produced by firing the cartridges.

The lyre connectors 212 make contact with T-shape members 140 on a printed circuit, this circuit carrying the power electronic components and the contacts for controlling the six electrical initiators of the strip.

The pyrotechnical part proper of each cartridge 150 is conventional in itself and will not be described in detail. Suffice it to say that, in the manner known in itself, each cartridge includes an electric initiator 151, a thrust disk 152, an ejector and igniter charge 153, a pyrotechnic block 154 and a payload of chaff 155, the whole being enclosed in a metal band 156 and slid into the housing constituted by the wall 160 of the strip. This pyrotechnic part preferably comprises safety means such as a conventional fuse offset device.

The modular system of strips of the invention as just described can optimize all dead volumes of the munition not only by accommodating the greatest number of cartridges meeting the applicable radiation requirements to implement the countermeasure function, but also by using rectangular or square cross-section cartridges with a payload/overall size ratio very much greater than that of prior art munitions, especially those using cylindrical cartridges.

All consumable parts are made from low-cost materials (molded materials) while delicate and complex parts, in particular the interfaces with the cartridge-launcher and the control and command circuits, are carried by the reusable support which can be machined from a block of light alloy, for example.

There is claimed:

1. a cartridge-launcher loader munition comprising a plurality of consumable modules each in the form of a flat strip of juxtaposed cartridges each comprising a payload of chaff, said strips having flat surfaces, an ejector pyrotechnic charge and electrical initiator means and a reusable support receiving the strips having means for immobilizing the strips and a handle for transporting and installing it, in which munition said flat surfaces of said strips are juxtaposed to form a homogeneous block essentially constituting at least a part of the body of the munition and the support includes a fixed plate carrying said strips and receiving the latter, when they are inserted by sliding in a direction substantially parallel to a plane of said plate, wherein said support further includes a wall perpendicular to the plane of said plate against which said strips abut at the end of insertion, and wherein said strips each have a flat side including a locking through-hole, respective holes of a block of strips being mutually aligned, the munition further comprising a locking pin inserted into the series of aligned holes of said block to fasten said strips together.

2. A cartridge-launcher loader munition comprising a plurality of consumable modules each in the form of a flat strip of juxtaposed cartridges each comprising a payload of chaff, said strips having flat surfaces, an ejector pyrotechnic charge and electrical initiator means and a reusable support receiving the strips having means for immobilizing the strips and a handle for transporting and installing it, in which munition said flat surfaces of said strips are juxtaposed to form a homogeneous block essentially constituting at least a part of the body of the munition and the support includes a fixed plate carrying said strips and receiving the latter, when they are inserted by sliding in a direction substantially parallel to a plane of said plate, wherein said support further includes a wall perpendicular to the plane of said plate against which said strips abut at the end of insertion, and wherein said wall is substantially centrally located relative to a surface of said plate, said plate carrying two groups of strips symmetrically disposed on respective sides of said wall and said strips of each group abutting against a respective one of two opposite sides of said wall, said strips each having a flat side with a locking through-hole, respective holes of the block of strips being all aligned, the munition further comprising a locking pin inserted into the series of aligned holes of said block to fasten said strips together, and wherein said pin is a double pin with two branches straddling the wall and each inserted into the respective series of aligned holes in two groups of strips symmetrically disposed on opposite sides of said wall.

3. A cartridge-launcher loader munition comprising a plurality of consumable modules each in the form of a flat strip of juxtaposed cartridges each comprising a payload of chaff, said strips having flat surfaces, an ejector pyrotechnic charge and electrical initiator means and a reusable support receiving the strips having means for immobilizing the strips and a handle for transporting and installing it, in which munition said flat surfaces of said strips are juxtaposed to form a homogeneous block essentially constituting at least a part of the body of the munition and the support includes a fixed plate carrying said strips and receiving the latter, when they are inserted by sliding in a direction substantially parallel to a plane of said plate, wherein said support further includes a wall perpendicular to the plane of said plate against which said strips abut at the end of insertion, and wherein the side of said strip abutted against said wall carries a centering and locking pin which is inserted at the end of insertion into a cooperating hole in said wall.

4. A cartridge-launcher loader munition comprising a plurality of consumable modules each in the form of a flat strip of juxtaposed cartridges each comprising a payload of chaff, said strips having flat surfaces, an ejector pyrotechnic charge and electrical initiator means and a reusable support receiving the strips having means for immobilizing the strips and a handle for transporting and installing it, in which munition said flat surfaces of said strips are juxtaposed to form a homogeneous block essentially constituting at least a part of the body of the munition and the support includes a fixed plate carrying said strips and receiving the latter, when they are inserted by sliding in a direction substantially parallel to a plane of said plate, wherein said support further includes a wall perpendicular to the plane of said plate against which said strips abut at the end of insertion, and wherein a hole is provided in the side of said strip abutting against said wall, a centering and locking pin carried by said wall being inserted into said hole at the end of insertion.

5. A cartridge-launcher loader munition comprising a plurality of consumable modules each in the form of a flat strip of juxtaposed cartridges each comprising a payload of chaff, said strips having flat surfaces, an ejector pyrotechnic charge and electrical initiator means and a reusable support receiving the strips having means for immobilizing the strips and a handle for transporting and installing it, in which munition said flat surfaces of said strips are juxtaposed to form a homogeneous block essentially constituting at least a part of the body of the munition and the support includes a fixed plate carrying said strips and receiving the latter, when they are inserted by sliding in a direction substantially parallel to a plane of said plate, wherein said support further includes a wall perpendicular to the plane of said plate against which said strips abut at the end of insertion, and wherein said transport and installation handle is a retractable handle carried by said wall and provided with lateral projections which, after insertion of the munition into the cartridge-launcher and retraction of said handle, locates in a gap between the munition and the cartridge-launcher, thereby eliminating any clearance between said munition and said cartridge-launcher, and holds the munition in place in said cartridge-launcher after folding down a locking stirrup of the cartridge-launcher, said lateral projections further preventing folding down of said stirrup when said handle is deployed.

6. A cartridge-launcher loader munition comprising a plurality of consumable modules each in the form of a flat strip of juxtaposed cartridges each comprising a payload of chaff, said strips having flat surfaces, an ejector pyrotechnic charge and electrical initiator means and a reusable support receiving the strips having means for immobilizing the strips and a handle for transporting and installing it, in which munition said flat surfaces of said strips are juxtaposed to form a homogeneous block essentially constituting at least a part of the body of the munition and the support includes a fixed plate carrying said strips and receiving the latter, when they are inserted by sliding in a direction substantially parallel to a plane of said plate, wherein said support further includes a wall perpendicular to the plane of said plate against which said strips abut at the end of insertion, and wherein the means for guiding the strips and mechanically coupling the strips to the plate comprise a printed circuit fastened to the plate and carrying electrical tracks cooperating elastically with an homologous contact connected to electrical initiator means of each cartridge in said strip.

* * * * *

UNITED STATES PATENT AND TRADEMARK OFFICE

CERTIFICATE OF CORRECTION

PATENT NO. : 5,554,815
DATED : September 10, 1996
INVENTOR(S) : Christian Authie, et al.

It is certified that error appears in the above-identified patent and that said Letters Patent is hereby corrected as shown below:

On the title page item,
[73] Change "Toux" to --Tous--.

Signed and Sealed this

Third Day of March, 1998

*Attest:*

*Attesting Officer*

BRUCE LEHMAN

*Commissioner of Patents and Trademarks*